US007478891B2

(12) United States Patent
Hollenstein

(10) Patent No.: US 7,478,891 B2
(45) Date of Patent: Jan. 20, 2009

(54) SUPPORT ARM DRIVE FOR CABINET LIDS

(75) Inventor: Helmut Hollenstein, Lustenau (AT)

(73) Assignee: Julius Blum GmbH, Hochst (AT)

( * ) Notice: Subject to any disclaimer, the term of this patent is extended or adjusted under 35 U.S.C. 154(b) by 114 days.

(21) Appl. No.: 11/498,151

(22) Filed: Aug. 3, 2006

(65) Prior Publication Data

US 2006/0284530 A1 Dec. 21, 2006

Related U.S. Application Data

(63) Continuation of application No. PCT/AT2005/000012, filed on Jan. 24, 2005.

(30) Foreign Application Priority Data

Feb. 9, 2004 (AT) ..... GM91/2004

(51) Int. Cl.
*E05D 15/26* (2006.01)

(52) U.S. Cl. ..... 312/319.2; 312/328

(58) Field of Classification Search ..... 312/325, 312/327, 328, 116, 139, 138.1, 319.2, 319.3; 16/286; 49/246, 248; 160/213
See application file for complete search history.

(56) References Cited

U.S. PATENT DOCUMENTS 2,483,947 A * 10/1949 Turner ..... 217/60 C
5,524,979 A * 6/1996 Carson et al. ..... 312/319.2
5,904,411 A * 5/1999 Hayakawa ..... 312/319.2
5,971,514 A 10/1999 Hayakawa
6,088,964 A * 7/2000 Scherrer ..... 49/200
6,361,132 B2 * 3/2002 Kawanabe ..... 312/319.2
6,877,830 B2 * 4/2005 Salice ..... 312/327
7,168,477 B2 * 1/2007 Salice ..... 160/213
7,178,202 B2 * 2/2007 Hirtsiefer et al. ..... 16/366
7,231,692 B2 * 6/2007 Harada ..... 16/345
7,240,974 B2 * 7/2007 Hirtsiefer ..... 312/109
7,275,284 B2 * 10/2007 Lautenschlager et al. ..... 16/287
2008/0121490 A1 * 5/2008 Dubach et al. ..... 192/17 D

FOREIGN PATENT DOCUMENTS

| | | |
|---|---|---|
| DE | 40 01 199 | 7/1990 |
| DE | 199 15 164 | 10/1999 |
| DE | 201 16 197 | 3/2003 |
| EP | 0 819 865 | 1/1998 |
| EP | 1 217 159 | 6/2002 |

* cited by examiner

*Primary Examiner*—Janet M Wilkens
(74) *Attorney, Agent, or Firm*—Wenderoth, Lind & Ponack, L.L.P.

(57) ABSTRACT

An actuating-arm drive is provided for cupboard doors. The drive includes an actuating arm that is hinged to a door and is subjected to the action of a spring. The actuating arm can be tilted over a pivoting area that is delimited by two end positions. The actuating-arm drive is equipped with at least one damper that damps the tilting motion of the actuating arm before the arm reaches either of the two end positions.

17 Claims, 6 Drawing Sheets

22
24
3
1
2
4

22
24
4
4
2
3
1

1
10
11
7
20
8
5
2
9
12
16
18
6
19

SUPPORT ARM DRIVE FOR CABINET LIDS

This application is a continuation of International application PCT/AT2005/000012, filed Jan. 24, 2005.

BACKGROUND OF THE INVENTION

The invention relates to a support arm drive for cabinet lids comprising a support arm hinged to a lid, which support arm preferably is biased by at least one spring and can be pivoted through a pivotal range limited by two stop positions. The support arm drive further comprises at least one damper, which cushions the pivotal movement of the adjusting arm.

A support arm drive of this kind allows the controlled opening and closing of a lid. Lids of this kind are provided especially on high cupboards (cabinets). They can be designed as a single lid or also as a folding lid. An example of an item of furniture with a support arm drive of this kind is disclosed in DE 101 45 856 A1.

SUMMARY OF THE INVENTION

The object of the invention is to improve a support arm drive of this kind.

The object of the invention is achieved in that the damper/dampers cushions/cushion the pivotal movement of the support arm before the two stop positions of the support arm. A neutral region, in which the movement of the support arm is not influenced by the damper/dampers, is provided between the two cushioned regions.

With the design of the support arm drive according to the invention, the lid is pushed into the open position by the support arm drive just before it reaches its uppermost stop position and is thereby cushioned. Just before it reaches the closed position in its lowest stop position, the movement of the lid is also cushioned. Between these positions, there is a neutral pivotal range, in which the support arm drive holds the lid constantly in equilibrium.

A single damper, which cushions the pivotal movement of the support arm before both stop positions of the support arm, is advantageously provided.

BRIEF DESCRIPTION OF THE DRAWINGS

Various embodiments of the invention are described with reference to the figures in the attached drawings. The drawings are as follows.

DETAILED DESCRIPTION OF THE INVENTION

Figure 1:
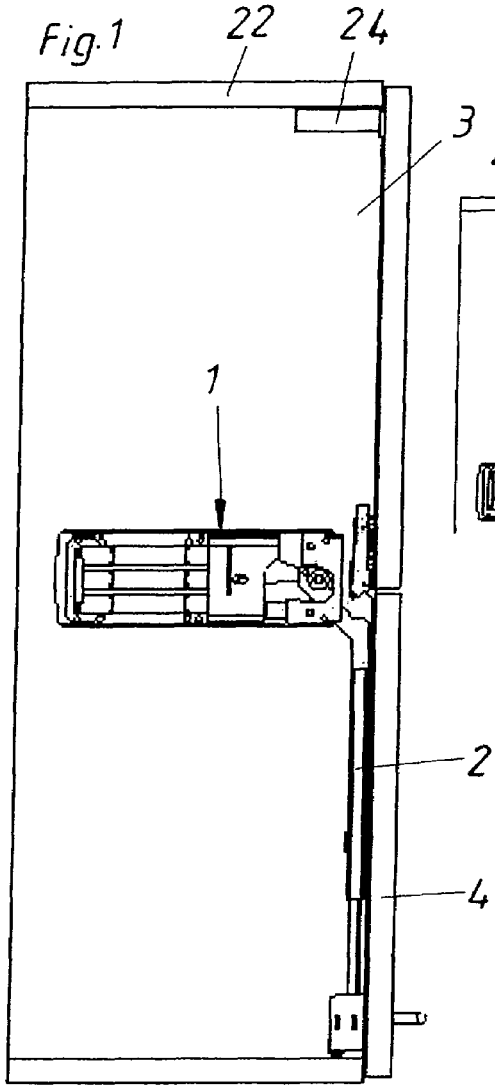
FIG. 1 is a vertical section view through a cupboard with the lid closed.
Figure 2:
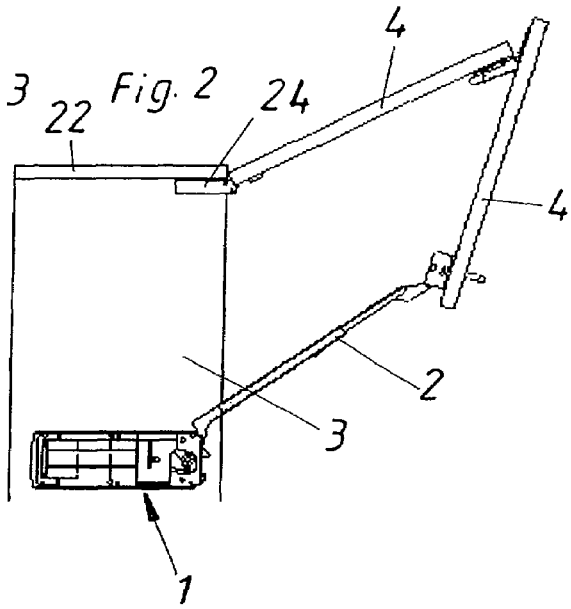
FIG. 2 is a vertical section view through the same cupboard with the lid open.

The support arm drive 1 according to the invention is attached together with the support arm 2 to a side wall 3 of a high cupboard.

The free end of the support arm 2 is hinged to a lid 4. The support arm 2 is connected in a pivotal manner to an axis 5 of the support arm drive 1. Moreover, the support arm 2 is designed as a two-arm lever with a short lever arm 6, to which a control element 7 is connected in an articulated manner via an axis 8.

The control element 7 has a control curve (i.e., a curved control surface) 9 in the form of a convex curved web at the distal end with reference to the axis 8.

Several, preferably three, compression springs 11, which press via a pressure component 12 on the control curve 9 of the control element 7, are mounted in the housing 10 of the support arm drive 1. A height-adjustable metal plate 21, which is disposed so as to contact the control curve 9, is mounted in the pressure component 12. There is no friction between the control element 7 and the metal plate 21 during the pivoting of the control element 7, because the metal plate 21 is height adjustable. The metal plate 21 can be disposed in a sliding bearing.

Figure 4:
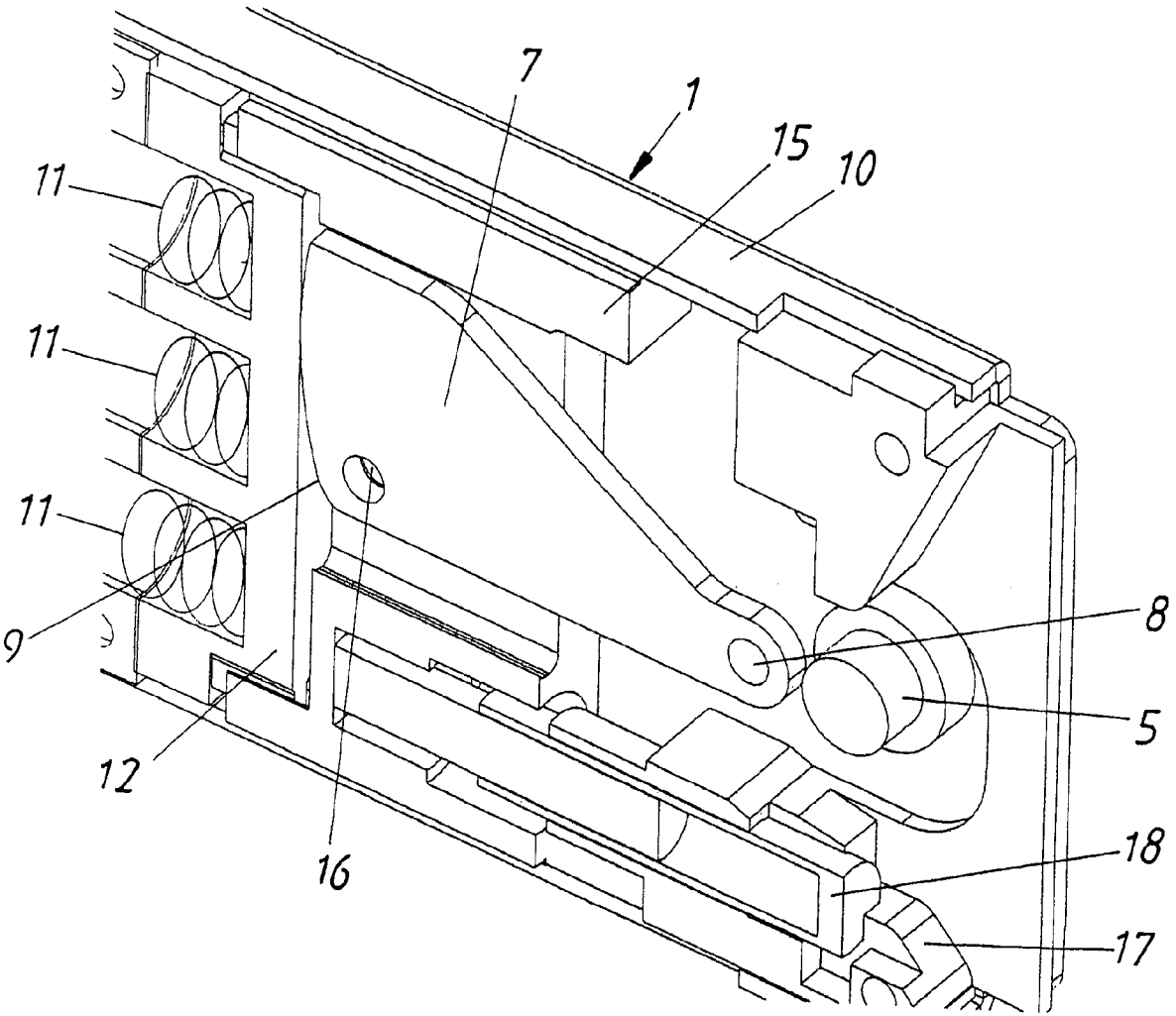
FIG. 4 is a chart of the front region of a support arm drive according to the invention, wherein the lid and the support arm have been omitted.

In the embodiment shown in FIG. 4, the control element 7 is mounted in a pivotal manner via an axis 16 on a slider 15, which is capable of linear movement.

Figure 5:
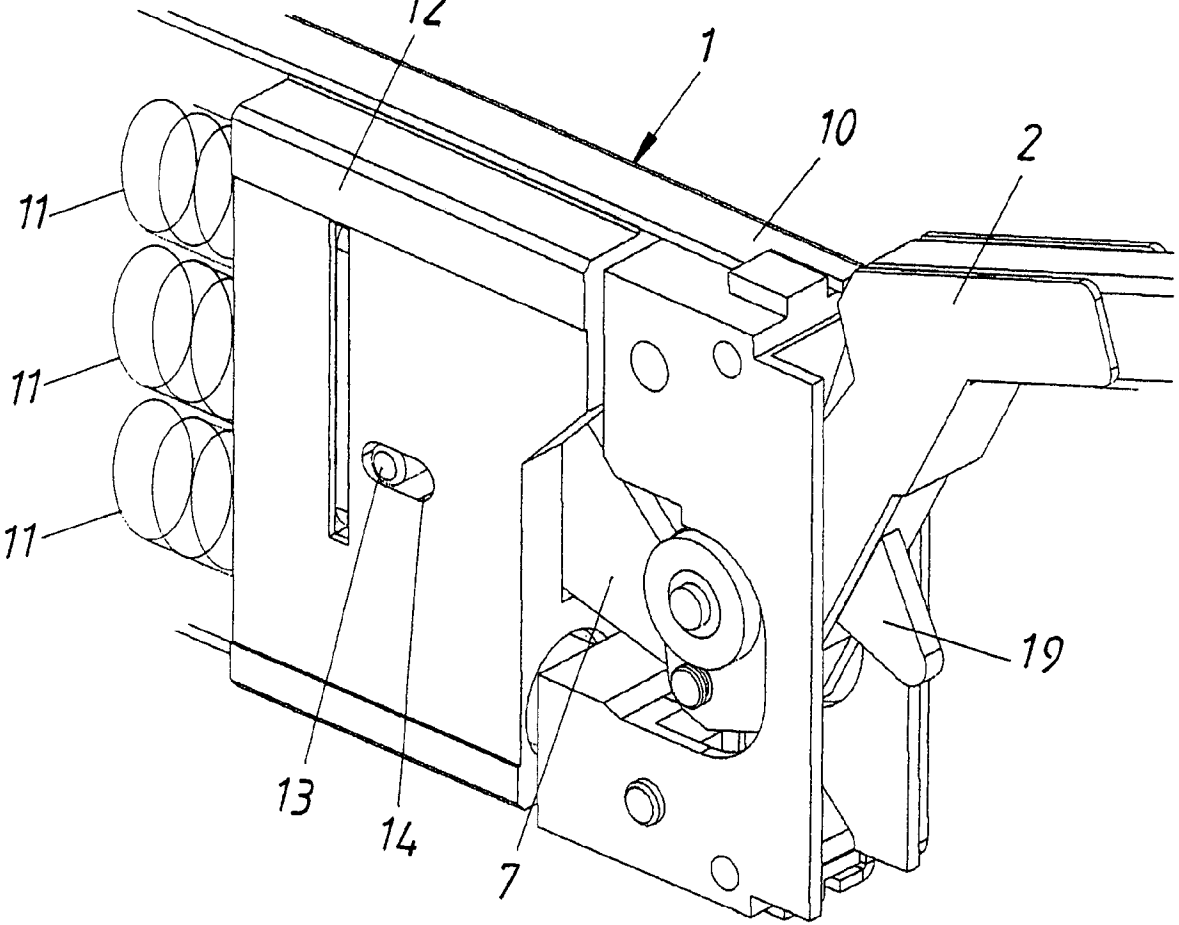
FIG. 5 is a chart of the front region of a support arm drive according to a further embodiment, wherein, once again, the lid has been omitted.
Figure 6:
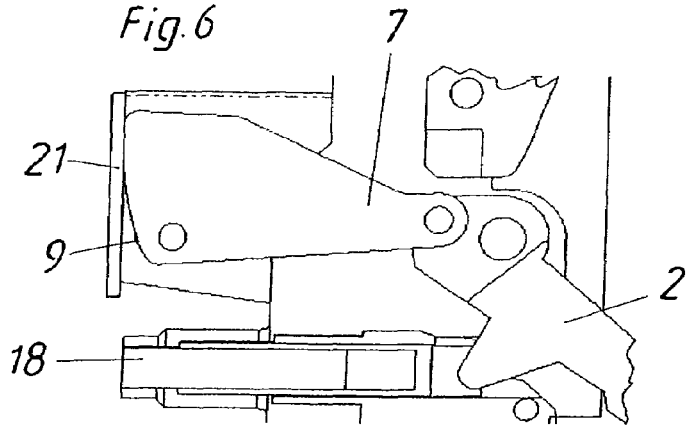
FIGS. 6 to 11 are plan views of the front region of a support arm drive with various positions of the lid.
Figure 6A:
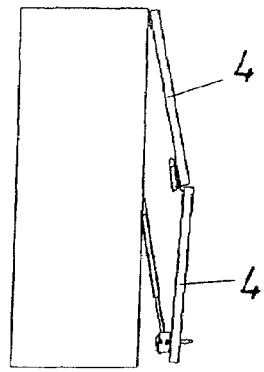
Figure 7:
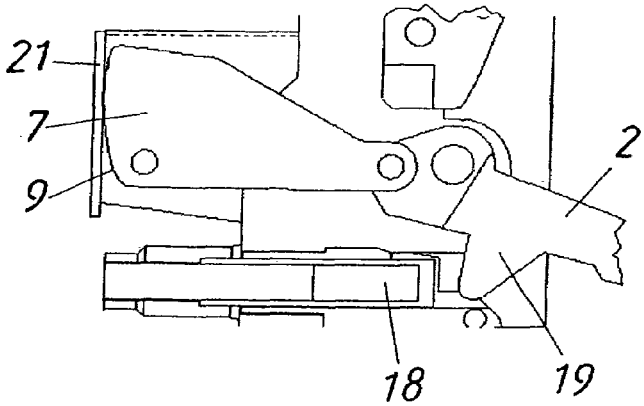
Figure 7A:
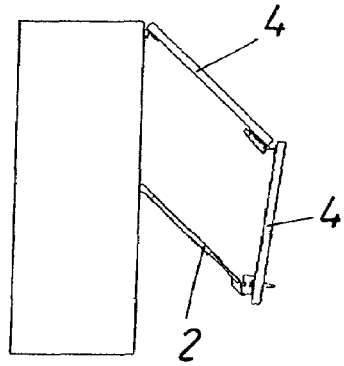
Figure 8:
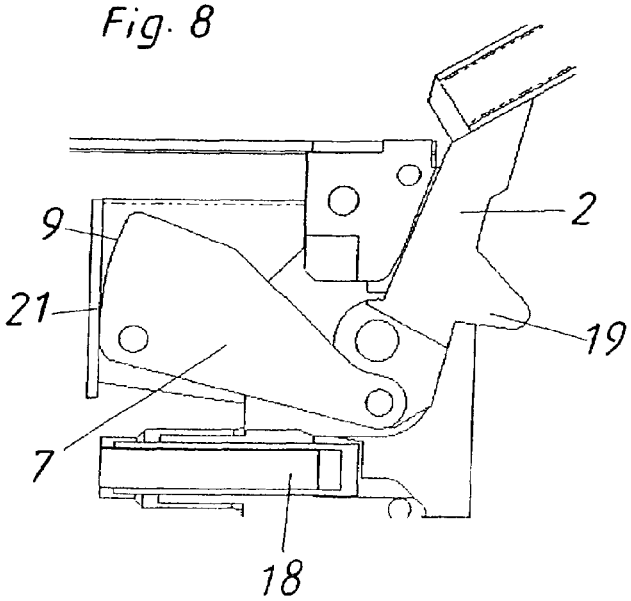
Figure 8A:
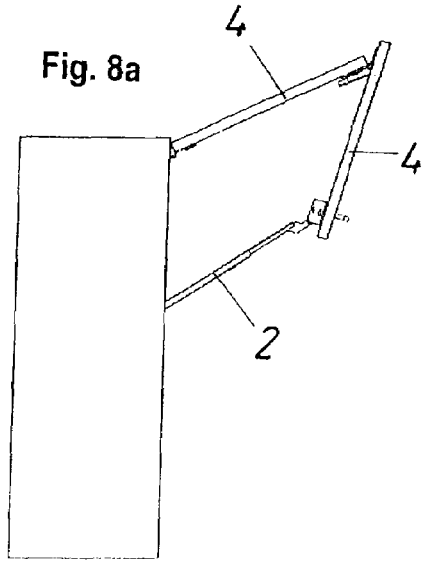
Figure 9:
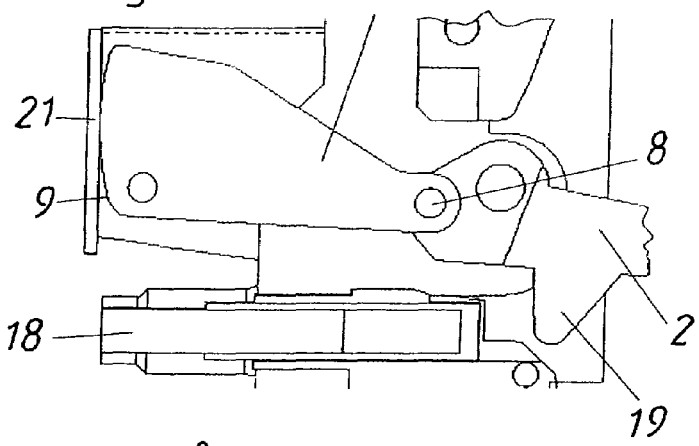
Figure 9A:
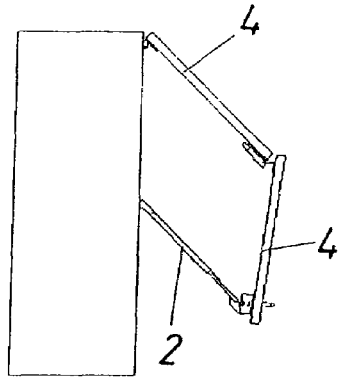
Figure 10:
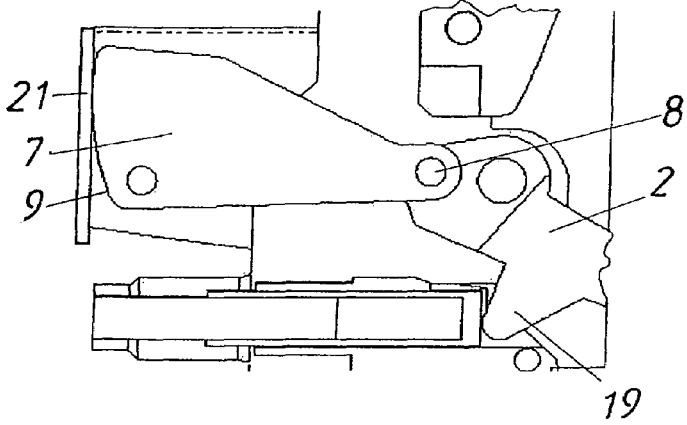
Figure 10A:
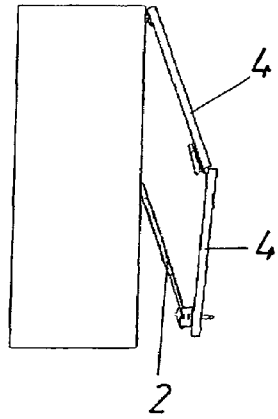
Figure 11:
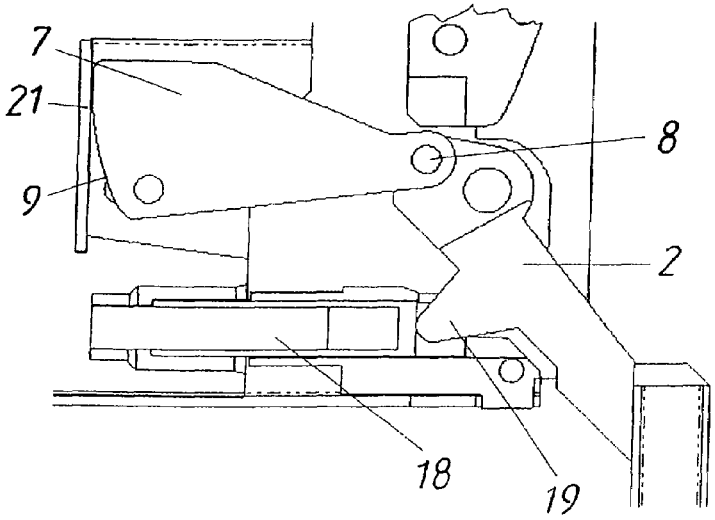
Figure 11A:
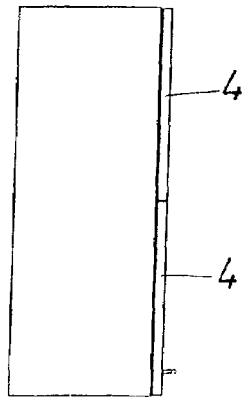
Figure 12A:
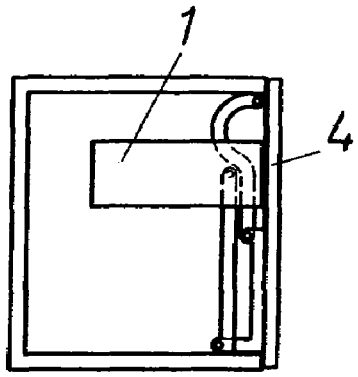
FIGS. 12 to 14 are various embodiments of an steering linkage for a lid in the closed and open positions of the lid respectively.
Figure 12B:
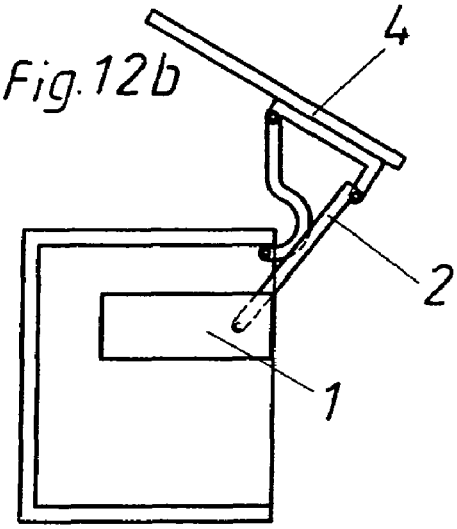
Figure 13A:
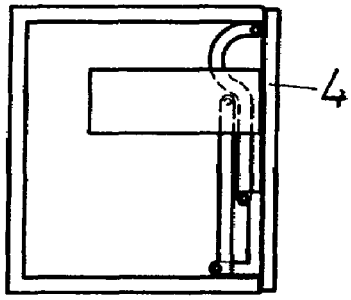
Figure 13B:
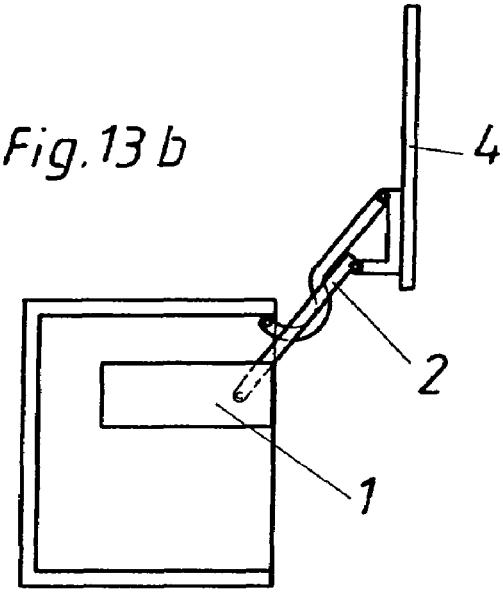
Figure 14A:
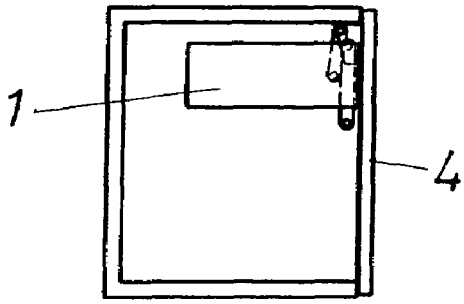
Figure 14B:
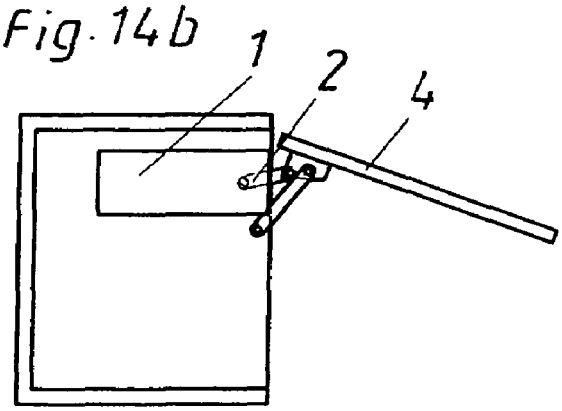

In the embodiment according to FIG. 5, the control element 7 is mounted in a pivotal manner on the pressure component 12, and in fact by means of an axis 13, which projects through an oblong borehole 14 in the pressure component 12. As a result of the axis 13 and the oblong borehole 14, the control element 7 is mounted so that it can be pivoted and is also capable of linear movement relative to the pressure component 12.

The control curve 9 is designed in such a manner that the support arm 2 is pushed by the springs 11 into the uppermost stop position just before reaching its uppermost end stop, and into its lowest closed position just before reaching the lowest stop position. Between these two positions, there is a neutral region, in which the lid 4 is held in equilibrium.

Figure 3:
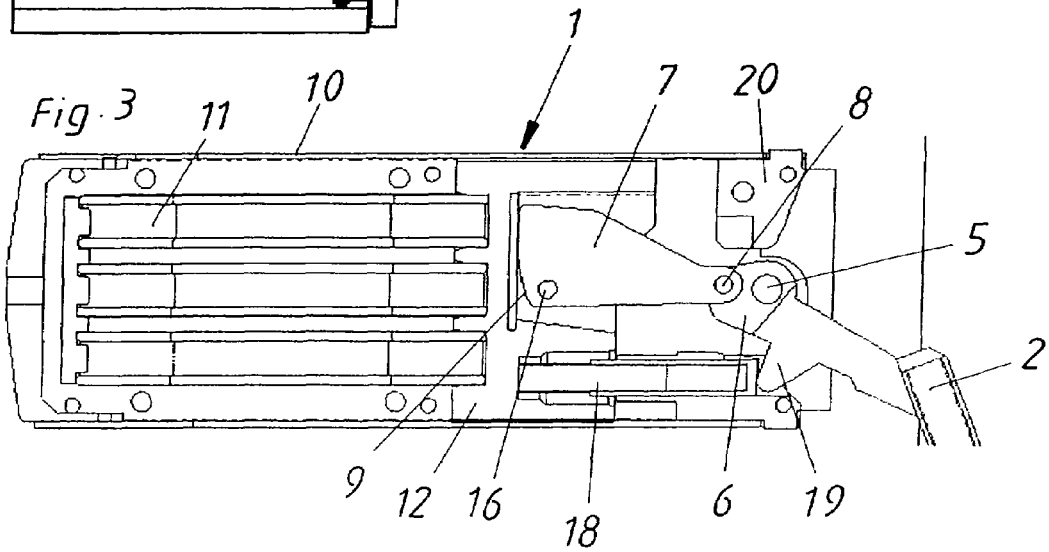
FIG. 3 is a plan view of a support arm drive according to the invention.

A damper 18, which is designed in the embodiment as a linear damper, is arranged between the pressure component 12 or the slider 15, which is capable of linear movement, and a stationary stop 17 formed on the housing 10 (see FIG. 4). Furthermore, the support arm 2 has a stop 19 for the damper 18 (see FIG. 3). If the lid 4 is raised, and the support arm 2 approaches the uppermost stop position, the slider 15, which is capable of linear movement, presses on the damper 18, which is supported on the other hand by the stop 17. Therefore, the damper 18 cushions the pivotal movement of the support arm 2 within this range.

If the lid 4 is lowered, and the support arm 2 approaches its lowest stop position, the stop 19 of the support arm 2 presses on the damper 18, of which the end disposed opposite to the stop 19 is supported by the slider 15, and which is capable of linear movement. In this manner, the support arm 2 is cushioned before reaching the lower stop position (that is to say, before reaching the closed position of the lid 4). Accordingly, one damper 18 is sufficient to cushion the movement of the support arm 2 for the opening and also for the closing of the lid 4.

In the illustrated embodiment, the support arm drive 1 is fitted with a single damper 18, which brakes the support arm 2 just before it reaches the closed position and also before it reaches the most extreme open position. However, two dampers 18 could also have been provided, wherein one of the dampers 18 brakes the support arm 2 when it reaches the closed position, and the second damper 18 brakes the support arm 2 when it reaches the open position. The two dampers 18 can provide different damping characteristics.

The cushioning distance and the cushioning power of the damper 18 and/or dampers 18 are advantageously adjustable.

The support arm drive 1 according to the invention is designed so that it can be attached to the left-hand side wall or to the right-hand side wall 3 of an item of furniture. The support arm drive 1 is advantageously provided with a covering cap, which can be attached optionally to the mutually-opposing flat sides of the support arm drive 1 depending on whether the support arm drive 1 is to be attached to the right-hand or the left-hand side wall 3 of an item of furniture.

Moreover, a further stop 20, which establishes the uppermost stop position of the support arm 2, is provided in the housing 10.

The damper 18 in the illustrated embodiment is designed as a linear damper and as a fluid damper. However, an air damper and also a hydraulic damper can also be used.

The invention claimed is:

1. A support arm drive to be attached to a lid, comprising:

a housing;

a support arm having a first end to be hinged to the lid, and having a second end hinged to said housing such that said support arm is operable to pivot through a pivotal range limited by a first stop and a second stop;

at least one damper for cushioning the pivotal movement of said support arm in a first cushion region at said first stop, and for cushioning the pivotal movement of said support arm in a second cushion region at said second stop, said support arm and said at least one damper being arranged such that said support arm is operable to move through a neutral region between the first cushion region and the second cushion region, wherein movement of said support arm through the neutral region is not influenced by said at least one damper;

a control element connected in an articulated manner to said support arm, said control element having a curved control surface;

a pressure component directly contacting said control surface, said pressure component being operable to move linearly through said housing; and at least one spring for applying pressure against said control surface of said control element via said pressure component, said at least one damper being located between said pressure component and a stationary stop of said housing.

2. The support arm drive of claim 1, wherein said at least one damper comprises a single, unitary damper for cushioning both the pivotal movement of said support arm in a first cushion region at said first stop, and the pivotal movement of said support arm in a second cushion region at said second stop.

3. The support arm drive of claim 1, wherein at least one of said first stop and said second stop is located on said support arm so as to contact said at least one damper.

4. The support arm drive of claim 1, wherein said pressure component comprises a slider, said control element being mounted in a pivotal manner on said slider.

5. The support arm drive of claim 1, wherein each of said at least one damper comprises a fluid damper.

6. The support arm drive of claim 5, wherein each of said at least one fluid damper comprises a linear fluid damper.

7. The support arm drive of claim 1, wherein said control surface of said control element comprises a convex curve at a distal end of said control element with respect to a base end of said control element at which said control element is connected to said support arm.

8. The support arm drive of claim 1, wherein said support arm drive is designed to be fitted to either of a left-hand side wall and a right-hand side wall of an item of furniture.

9. The support arm drive of claim 8, further comprising a covering cap attached to mutually-opposing flat sides of said support arm drive.

10. A support arm drive to be attached to a lid, comprising:

a housing;

a support arm having a first end to be hinged to the lid, and having a second end hinged to said housing such that said support arm is operable to pivot through a pivotal range limited by a first stop and a second stop;

at least one fluid damper for cushioning the pivotal movement of said support arm in a first cushion region at said first stop, and for cushioning the pivotal movement of said support arm in a second cushion region at said second stop, said support arm and said at least one fluid damper being arranged such that said support arm is operable to move through a neutral region between the first cushion region and the second cushion region, wherein movement of said support arm through the neutral region is not influenced by said at least one fluid damper; and at least one spring for biasing said support arm.

11. The support arm drive of claim 10, wherein said at least one fluid damper comprises a single, unitary fluid damper for cushioning both the pivotal movement of said support arm in a first cushion region at said first stop, and the pivotal movement of said support arm in a second cushion region at said second stop.

12. The support arm drive of claim 10, further comprising a pressure component being operable to move linearly through said housing, and a control element connected in an articulated manner to said support arm, said pressure component comprises a slider, said control element being mounted in a pivotal manner on said slider.

13. The support arm drive of claim 10, wherein each of said at least one fluid damper comprises a linear fluid damper.

14. The support arm drive of claim 10, further comprising a control element connected in an articulated manner to said support arm, a control surface of said control element comprises a convex curve at a distal end of said control element with respect to a base end of said control element at which said control element is connected to said support arm.

15. The support arm drive of claim 10, wherein said support arm drive is designed to be fitted to either of a left-hand side wall and a right-hand side wall of an item of furniture.

16. The support arm drive of claim 10, further comprising a covering cap attached to mutually-opposing flat sides of said support arm drive.

17. A support arm drive to be attached to a lid, comprising:

a housing;

a support arm having a first end to be hinged to the lid, and having a second end hinged to said housing such that said support arm is operable to pivot through a pivotal range limited by a first stop and a second stop; and at least one fluid damper for cushioning the pivotal movement of said support arm in a first cushion region at said first stop, and for cushioning the pivotal movement of said support arm in a second cushion region at said second stop, said support arm and said at least one fluid damper being arranged such that said support arm is operable to move through a neutral region between the first cushion region and the second cushion region, wherein movement of said support arm through the neutral region is not influenced by said at least one fluid damper;

wherein at least one of said first stop and said second stop is located on said support arm so as to contact said at least one fluid damper.

* * * * *